US007419003B2

(12) United States Patent
Russell

(10) Patent No.: US 7,419,003 B2
(45) Date of Patent: Sep. 2, 2008

(54) EROSION RESISTANT APERTURE FOR A DOWNHOLE VALVE OR PORTED FLOW CONTROL TOOL

(75) Inventor: Ronnie D. Russell, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 270 days.

(21) Appl. No.: 11/140,217

(22) Filed: May 27, 2005

(65) Prior Publication Data

US 2005/0269076 A1 Dec. 8, 2005

Related U.S. Application Data

(60) Provisional application No. 60/576,355, filed on Jun. 2, 2004.

(51) Int. Cl.
*E21B 17/10* (2006.01)

(52) U.S. Cl. ..... 166/242.4; 166/902; 166/227

(58) Field of Classification Search ..... 166/242.4, 166/902, 227, 228; 175/393, 340, 424; 405/43, 405/45, 50; 52/152.5
See application file for complete search history.

(56) References Cited

U.S. PATENT DOCUMENTS 986,940 A * 3/1911 Osborne ..... 405/43
1,507,580 A * 9/1924 Cater ..... 166/227
1,839,284 A * 1/1932 White ..... 166/227
2,059,939 A * 11/1936 Fairfield ..... 166/227
2,751,194 A * 6/1956 Rohrback et al. ..... 166/243
4,603,113 A * 7/1986 Bauer ..... 436/6
5,095,977 A * 3/1992 Ford ..... 166/113
5,547,020 A * 8/1996 Sable et al. ..... 166/65.1
5,699,918 A * 12/1997 Dunn ..... 209/397
6,371,208 B1 * 4/2002 Norman et al. ..... 166/334.4

OTHER PUBLICATIONS

Mullen, Mike, et al., Deepwater Reservoirs Requiring High Rate/Volumn Frac Packing Continue to Stretch Downhole Tool Capabilities—Latest Tool.
Design and Qualification Testing Results; AADE-03-NTCE-18; Apr. 1-3, 2003; pp. 1-15.

* cited by examiner

*Primary Examiner*—Giovanna C Wright
(74) *Attorney, Agent, or Firm*—Steven Rosenblatt

(57) ABSTRACT

An aperture design minimizes erosion on the surrounding casing and to the aperture itself and is particularly effective in fluid injection wells where large volumes of fluids over a long period of time with entrained solids are expected to be pumped through. The preferred design is an elongated shape with a flaring wider in the downhole direction. The downhole end of the opening features an exit that flares in the downhole direction with multiple slopes with an arc transition. Other options for the opening configuration are envisioned.

19 Claims, 3 Drawing Sheets

EROSION RESISTANT APERTURE FOR A DOWNHOLE VALVE OR PORTED FLOW CONTROL TOOL

PRIORITY INFORMATION

This application claims the benefit of U.S. Provisional Application No. 60/576,355, filed on Jun. 2, 2004.

FIELD OF THE INVENTION

The field of this invention is aperture shape for downhole valves or ported flow control tools and more particularly valves or tools of the sliding sleeve type for use in fluid injection wells.

BACKGROUND OF THE INVENTION

When production becomes marginal in a given zone in a field, one way to bolster production is to inject large quantities of fluid such as water or steam into an injection well at one point in the zone or zones in question and take additional production in another well or wells in the field. In the injection well pumping equipment is used to move large amounts of fluid into the well to get the desired enhanced production. The injection well can have a valve, typically of a sliding sleeve design, to allow access into a single zone at a time and in turn service multiple zones, if desired. These sliding sleeve valves have a sleeve with a port where the port can be selectively brought into alignment with the housing around it. The injection well can have a service life as long as 15 years or more. In the course of its life span, high fluid volumes and large weights of entrained solids can be forced through a single sliding sleeve valve, when it is in the open position. It would not be unusual that in the life of such a well injection rates of about 45,000 barrels per day would be used. This could result in 250 million barrels pumped during the life of the well. Additionally, with solids content of about one pound per 1000 barrels the amount of solids pumped through such an opening could reach 250,000 pounds of fine sand, generally smaller than 50 micron and having a generally sharp and angular shape, being pumped through the open port in the expected life of the well.

Maintaining these rates over long periods has raised concerns about erosion of the opening in the tool and more significantly to the surrounding casing In the past, other work has been done relating to crossover tools used in high rate high volume frac packing, as reported in the American Association of drilling Engineers (AADE) paper 03-NTCE-18 in 2003 by a group of engineers from Halliburton Energy Services Inc. In this application there are high flow volumes with significantly more solids content than in fluid injection applications. In the design tested in this paper, both the tool body and the sliding sleeve had matching ports that were created by simply angling a drill at a predetermined angle from the axis of the tool and drilling in an uphole direction through the tool body and the sleeve. This technique results in an oval shaped opening when viewed in a line perpendicular to the tool axis. The hole appears narrower at the top and bottom because of the slant in the drilling process and having generally parallel slopes at the uphole and downhole ends, again resulting from the slant drilling technique. While positive results were reported for high flows and high solids content application of frac packing, the overall volumes of fluid pale in comparison with the volumes of fluid and solids used during the life of an injection well.

As a result of these differences simulations (such as CFD, Computational Fluid Dynamic models or simulations were run to evaluate port effectiveness) and field tests have led to an improved port design to minimize erosive effects on the surrounding casing and to the ports themselves. The resulting port designs feature elongated openings that flare in the downhole direction. It further can feature a multi-sloped downhole outlet composed of ramps or/and curves. These and other features of the invention will be more readily appreciated by those skilled in the art from a review of the description of the preferred embodiment and the claims that appear below.

SUMMARY OF THE INVENTION

An aperture design minimizes erosion on the surrounding casing and to the aperture itself and is particularly effective in fluid injection wells where large volumes of fluids over a long period of time with entrained solids are expected to be pumped through. The preferred design is an elongated shape with a flaring wider in the downhole direction. The downhole end of the opening features an exit that flares in the downhole direction with multiple slopes with an arc transition. Other options for the opening configuration are envisioned.

DETAILED DESCRIPTION OF THE PREFERRED EMBODIMENT

Figure 1:
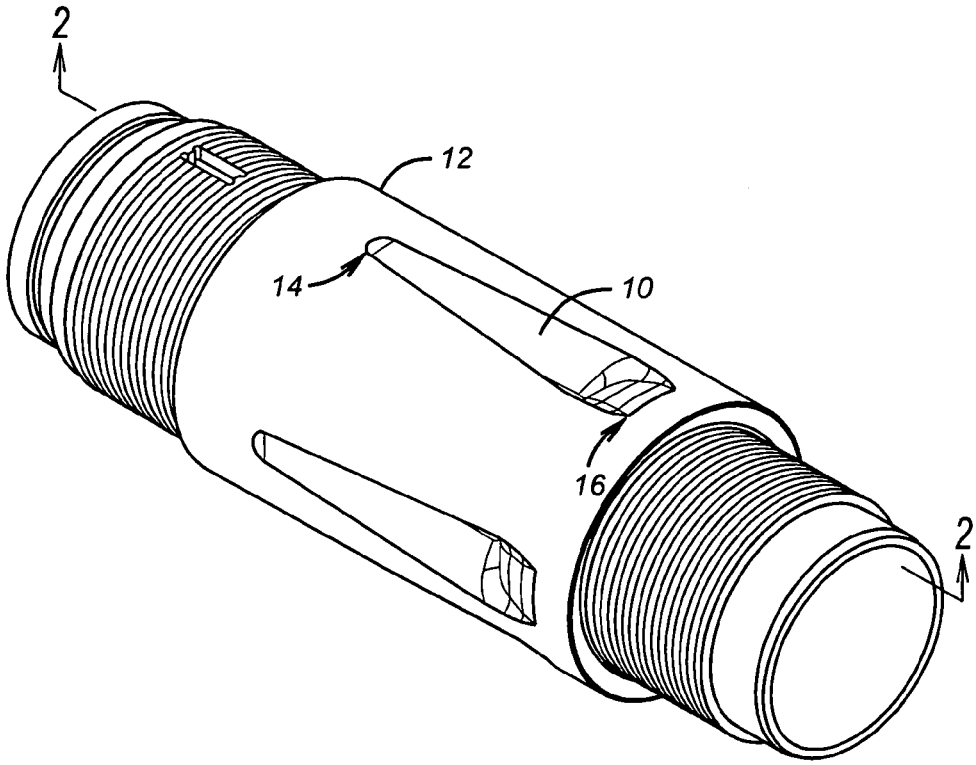
FIG. 1 is an isometric view of the preferred embodiment.
Figure 2:
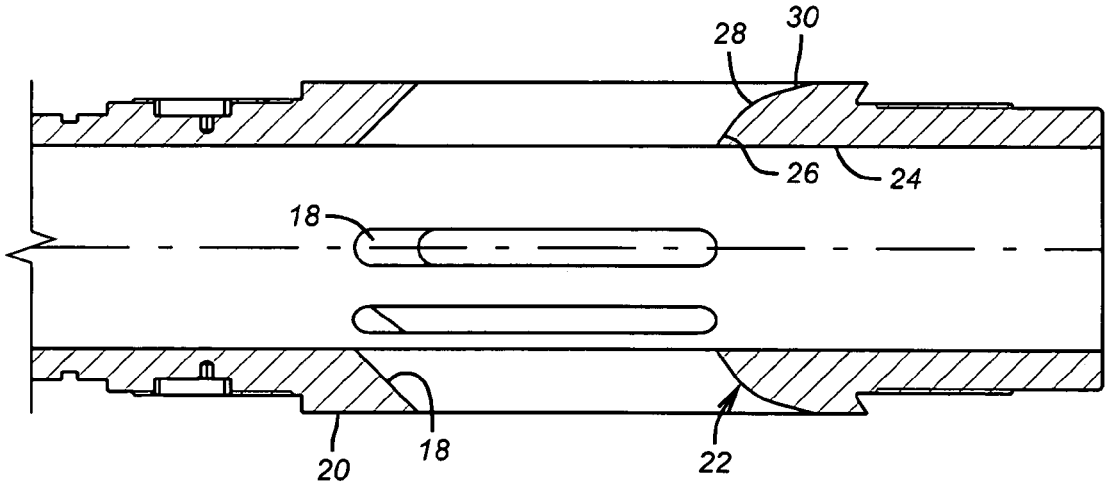
FIG. 2 is a section through the assembly along line 2-2 of FIG. 1.
Figure 3:
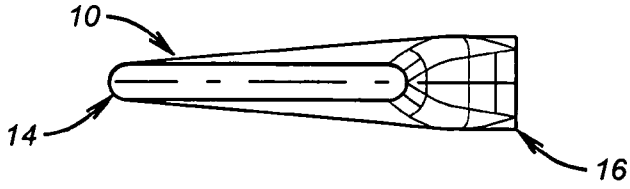
FIG. 3 is a plan view of the aperture shown in section in FIG. 2.

FIG. 1 shows an exterior view of the aperture 10 in the housing 12. A conforming opening is located on the sliding sleeve (not shown) that can be moved between an open position and a closed position with a known tool. One or more assemblies may be mounted on a single string in a wellbore to allow selection of the zone into which the fluid is to be pumped for injection purposes. Surrounding this structure shown in FIGS. 1-3 is generally casing (not shown). The flow comes out of the aperture 10 and into the cased surrounding wellbore. Aperture 10 has an uphole end 14 and a downhole end 16. The number of apertures can be varied to accommodate the anticipated flow rates to keep the velocity in a desired range. A range of about 35-65 feet per second is preferred.

Referring to FIGS. 2 and 3 it can be seen that the aperture 10 has an elongated shape. From the inside looking out, in FIG. 2, the aperture 10 has a ramp 18 that is preferably at 45 degrees. While a single planar surface is shown for ramp 18 it is also possible to use multiple ramps with or without intervening transitional surfaces. Alternatively a combination of planar and arcuate surfaces can be used where the arcs are at a constant or varying radii. It is preferred that the larger radii be further uphole, if used on surface 18 so that at the outside surface 20 of the body 12 the curvature will be more pronounced.

At the downhole end 16 the preferred configuration of surface 22 between the inside surface 24 and the outside surface 20 is an initial ramp 26 of about 55 degrees followed by an arcuate segment 28 at about an inch and a quarter radius followed by an exit ramp 30 at about 15 degrees.

FIG. 3 shows the aperture 10 flaring out at a constant angle of about 10 degrees making the aperture 10 wider near the downhole end 16 than at the uphole end 14.

While these combinations of parameters represent the preferred embodiment other possibilities are within the scope of the invention. As one example the aperture 10 shape may feature a flaring wider from uphole to downhole end regardless of the flaring being along a straight line, an arc, a combination of a line or lines and an arc and where the arc segments have the same or varying radii. Furthermore, the surfaces can be arranged in any order going between inside surface 20 and outside surface 24. This feature alone without the other illustrated features of FIGS. 1-3 will perform better from a minimizing erosion point of view than a simple rectangular opening, shown in FIG. 4, that has parallel sides 32 and 34 and hence no flaring of a generally rectangular opening. Note in FIG. 4 that uphole surface 36 and downhole surface 38 are flat and are each a single ramp with both oriented perpendicularly to the axis of the tool While surface 36 & 38 are actually shown with perpendicular 90 degree ramp angle, they could be reoriented to improve performance by orienting both of them in down hole direction. While a flare angle of 10 degrees is preferred the flare angle can vary with the diameter of the body 12, the number and length of apertures 10 and the need to accommodate control lines (not shown), which are mounted out of the trajectory of coursing fluid through the apertures 10. Thus straight taper angles from about a degree to about 30 degrees are contemplated while even larger angles are also possible. This flare angle could also increase for the same port in a direction toward downhole by disposing increased angles in the down hole direction or gradual arcing or any combination of the two.

Another feature that can also stand-alone and produce erosion-minimizing properties, apart from the flare along the length discussed above, is the shape of the exit at the lower end 16. The base feature is to include more than a single surface. A single flat exit surface 42 is shown in FIG. 6. It should be noted that although the opening in FIG. 6 gets wider from the inside of body 12 to outside as indicated by lines 44 and 46, in this view those lines are parallel so that there is no flaring of the width in the FIG. 6 design. Accordingly, just improving the exit at the lower end 16 of the aperture 10 without making the other modifications described, will yield erosion minimization. More than a single surface can be accomplished by two flat surfaces with the surface closest to the inside 24 of body 12 having the steeper angle. This feature is also illustrated with surface 46 being steeper than surface 48 in FIG. 5. Other alternatives envision flat surfaces with line transitions or arcuate surfaces of differing radii or combinations of flat and arcuate surfaces in any order and involving the same or different radii on the arcuate surfaces. Alternatively a single arc at a constant radius is possible as well as what looks like a single arc but is really a combination of arcs of different radii is also envisioned.

The upper end 14 can also have the same options as outlined for the lower end 16 and if that is the only feature used it will still help to minimize erosion but likely with less effect as a similar change done by itself in the manner described above to the lower end 16.

Of course, it would be more preferred to address the upper and lower ends 14 and 16 in each aperture either with similar surface, if not angle or radii combinations, however, the surface treatments at the ends need not be duplicates of each other. Indeed they are not as shown in the section view of FIG. 2. Using the two planar surface variation for the end treatment, the initial ramp can be in the range of about 50 to 90 degrees with 80 degrees being closer to optimal and the final ramp in the direction of flow can be between about 1 to 50 degrees.

Figure 4:
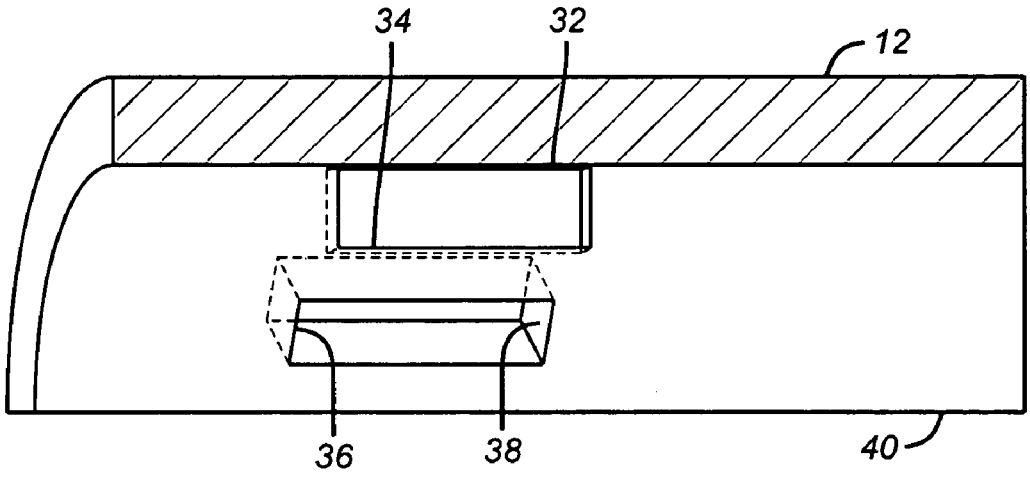
FIGS. 4-7 show progressively better performing designs that are an alternative to that shown in FIGS. 1-3 but each representing a design that is less favored on a performance basis than the preferred embodiment.
Figure 5:
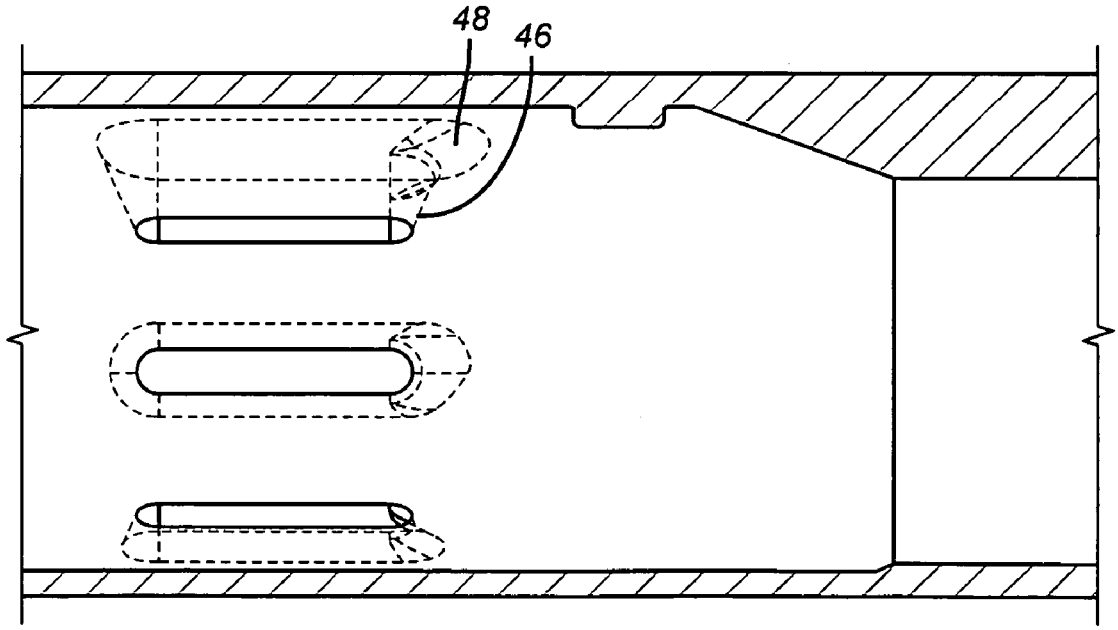
Figure 6:
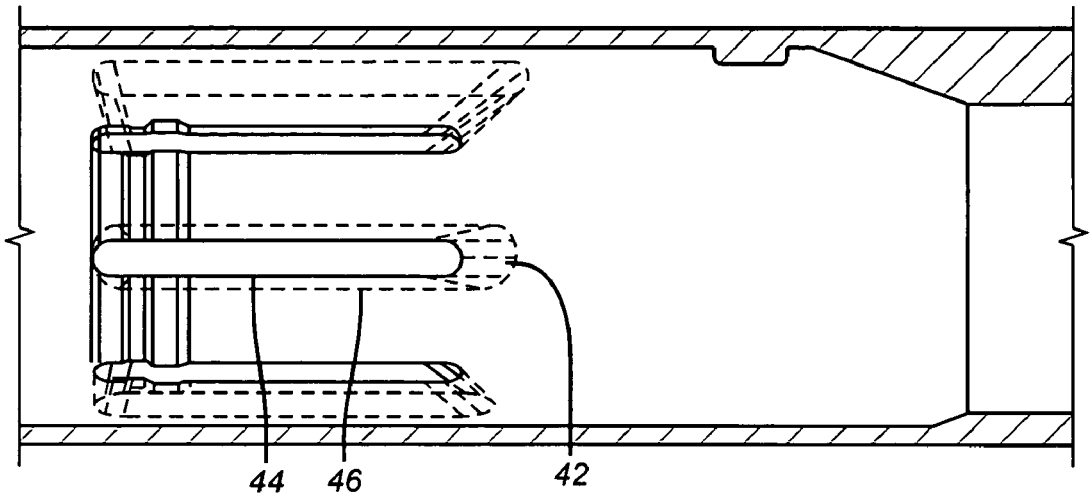
Figure 7:
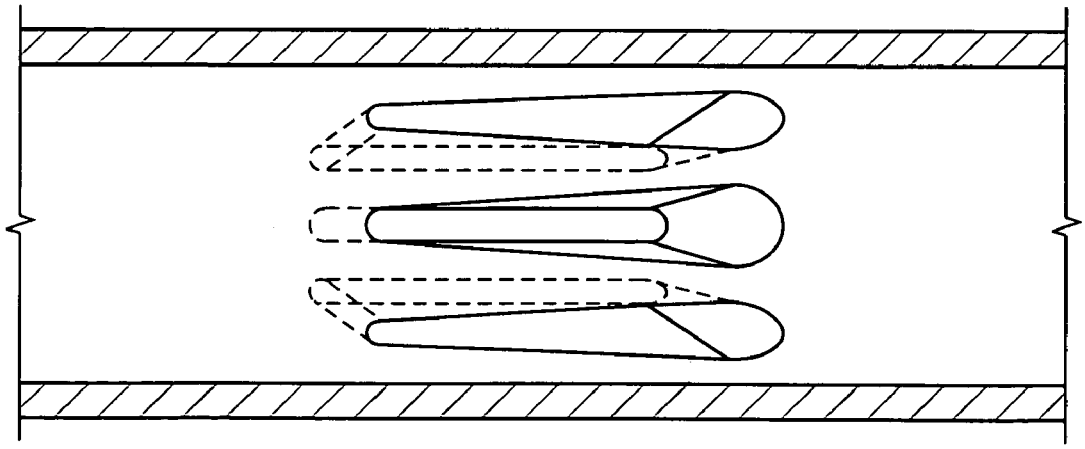

The designs of FIGS. 5-7 represent alternatives within the scope of the invention that show some different permutations over the basic design of an elongated opening, preferably rectangular that still performs better than the known prior art of drilling a hole using a drill held on a slant to the long axis of the housing. FIG. 4 is a basic design similar to a current product, which differs by having rounded uphole and downhole ends instead of flat/square ends. A feature of the prior art Halliburton ports is that they require multiple ports in series in a direction downstream, with the port sizes reduced in the downstream direction. Reduced port sizes downstream forces more flow through the up hole ports, which would otherwise see significantly reduced flow velocities. The downstream ports would otherwise erode most.

The above description is illustrative of the preferred embodiment and the full scope of the invention can be determined from the claims, which appear below.

I claim:

1. An aperture configuration for a downhole ported sub housing for slurry service, comprising:

a body adapted to be mounted in a tubular string for insertion downhole and having a passage to conduct slurry and defined by a curved wall and a longitudinal axis therein, and wherein said passage has the strength to conduct slurry at pressures sufficient for downhole fracturing service;

at least one uncovered aperture through said curved wall to conduct slurry out of said passage, said aperture having an uphole and a downhole end to allow fluid under pressure to flow through said curved wall and without further engaging said body;

said aperture flaring wider along a substantial portion of its length as it extends from its uphole to its downhole end.

2. The housing of claim 1, wherein:

said flaring occurs at a constant rate.

3. The housing of claim 2, wherein:

said downhole end of said aperture further comprises a second flare away from said longitudinal axis in the direction toward said downhole end;

said second flare comprises more than one surface.

4. The housing of claim 3, wherein:

said uphole end of said aperture further comprises a third flare away from said longitudinal axis in the direction toward said downhole end.

5. The housing of claim 1 wherein:

said flaring occurs at a variable rate.

6. The housing of claim 1 wherein:

said flaring occurs using a combination of flat surfaces disposed at different angles.

7. The housing of claim 1 wherein:

said flaring occurs using a combination of arcuate surfaces.

8. The housing of claim 1 wherein:

said flaring occurs using at least one flat surface and at least one arcuate surface.

9. The housing of claim 1 wherein:

said downhole end of said aperture further comprises a second flare away from said longitudinal axis in the direction toward said downhole end.

10. The housing of claim 9 wherein:

said second flare comprises more than one surface.

11. The housing of claim 10 wherein:

said second flare comprises at least one flat surface.

12. The housing of claim 11, wherein:

said second flare comprises at least one arcuate surface.

13. The housing of claim 10, wherein:

said second flare comprises at least one arcuate surface.

14. The housing of claim 10, further comprising:

a first surface closer to said longitudinal axis that is at a steeper angle to said longitudinal axis than a second surface farther from said longitudinal axis.

15. The housing of claim 14, wherein:

said first and second surfaces are flat and separated by an arcuate surface.

16. The housing of claim 14, wherein:

said first surface forms an angle in the range of about 50-90° with said longitudinal axis and said second surface forms an angle of about 1-50° with said longitudinal axis.

17. The housing of claim 1, wherein:

said uphole end of said aperture further comprises a second flare away from said longitudinal axis in the direction toward said downhole end.

18. The housing of claim 1 wherein:

said uphole end of said aperture further comprises a sloping flare away from said longitudinal axis in the direction toward said downhole end.

19. The housing of claim 1, wherein:

said flare is at an angle of about 1-30°.

* * * * *